US011331932B2

(12) United States Patent
Lee et al.

(10) Patent No.: US 11,331,932 B2
(45) Date of Patent: May 17, 2022

(54) MAGNETIC DOMAIN DRAWING APPARATUS

(71) Applicant: Ulsan National Institute of Science and Technology, Ulsan (KR)

(72) Inventors: Ki-Suk Lee, Ulsan (KR); Myeonghwan Kang, Ulsan (KR); Daehan Jeong, Ulsan (KR); Hee Sung Han, Ulsan (KR); Sooseok Lee, Ulsan (KR); Namkyu Kim, Ulsan (KR); Hye-Jin Ok, Ulsan (KR)

(73) Assignee: Ulsan National Institute of Science and Technology, Ulsan (KR)

( * ) Notice: Subject to any disclaimer, the term of this patent is extended or adjusted under 35 U.S.C. 154(b) by 229 days.

(21) Appl. No.: 16/809,945

(22) Filed: Mar. 5, 2020

(65) Prior Publication Data

US 2020/0282744 A1 Sep. 10, 2020

(30) Foreign Application Priority Data

Mar. 8, 2019 (KR) ..... 10-2019-0026954

(51) Int. Cl.
*B41J 2/43* (2006.01)
*B41J 2/40* (2006.01)

(52) U.S. Cl.
CPC ... *B41J 2/43* (2013.01); *B41J 2/40* (2013.01)

(58) Field of Classification Search
CPC ..... B41J 2/43; B41J 2/40
See application file for complete search history.

(56) References Cited

U.S. PATENT DOCUMENTS 4,170,415 A * 10/1979 Lemeshewsky ..... G01C 11/28 353/6
6,359,747 B1 * 3/2002 Kuo ..... G11B 5/59677 360/59
2010/0266961 A1 * 10/2010 Kawamura ..... H01L 21/682 430/319
2016/0223428 A1 * 8/2016 Matsuo ..... G03F 7/70291

FOREIGN PATENT DOCUMENTS

JP 2000-326547 A 11/2000
JP 2005-093889 A 4/2005
JP 2005093889 A * 4/2005 ..... H01L 21/288
KR 20-2000-0021424 A 12/2000
KR 10-2018-0005989 A 1/2018

* cited by examiner

*Primary Examiner* — Yaovi M Ameh
(74) *Attorney, Agent, or Firm* — Maier & Maier, PLLC

(57) ABSTRACT

A magnetic domain drawing apparatus includes a magnetic plate moving module including a magnetic plate seating part configured to hold a magnetic plate seated thereon and a magnetic plate moving part configured to move the magnetic plate seating part, and at least one of magnetic domain deforming modules disposed to be spaced apart from the magnetic plate seating part at a predetermined distance and configured to deform a magnetic domain of the magnetic plate when the magnetic plate is seated on the magnetic plate seating part. The at least one of magnetic domain deforming modules is configured to deform the magnetic domain of the magnetic plate by applying at least one of heat, a magnetic field and an external force to the magnetic plate.

14 Claims, 11 Drawing Sheets

MAGNETIC DOMAIN DRAWING APPARATUS

CROSS-REFERENCE TO RELATED APPLICATIONS

This application is based on and claims priority from Korean Patent Application No. 10-2019-0026954, filed on Mar. 8, 2019, the disclosure of which is incorporated herein in its entirety by reference for all purposes.

FIELD

The present disclosure relates to a magnetic domain drawing apparatus.

BACKGROUND

In general, magnetic printing may be implemented by using a point that magnetic particles contained in a magnetic ink are distributed at different densities depending on the magnetic force intensity.

In order to form a magnetic printing pattern, it is necessary to adjust the magnetic force intensity of a magnetic plate. In this regard, in the related art (e.g., Korean Patent No. 10-1881037), there has been proposed a "pattern formation method using a magnetic ink and a magnetic force" for permanently etching irregularities of a magnetic plate made of a permanent magnet.

However, in the case of such a related art, the irregularities of the magnetic plate are permanently cut. Therefore, it is impossible to adjust the magnetic force after the shape of the magnetic plate is determined. If the design of a magnetic printing pattern is changed, the irregularities of the magnetic plate have to be newly formed. In addition, since the magnetic printing pattern is also designed in an empirical manner, there is a problem that it is difficult to obtain a desired design other than a geometric shape.

Accordingly, a demand has existed for a technique capable of variably changing a unique pattern required for magnetic printing in a desired manner.

SUMMARY

Embodiments of the present disclosure provide a magnetic domain drawing apparatus capable of variously changing a magnetic domain of a magnetic plate.

In accordance with a first aspect of the present disclosure, there is provided a magnetic domain drawing apparatus, including: a magnetic plate moving module including a magnetic plate seating part configured to hold a magnetic plate seated thereon and a magnetic plate moving part configured to move the magnetic plate seating part; and at least one of magnetic domain deforming modules disposed to be spaced apart from the magnetic plate seating part at a predetermined distance and configured to deform a magnetic domain of the magnetic plate when the magnetic plate is seated on the magnetic plate seating part, wherein the at least one of magnetic domain deforming modules is configured to deform the magnetic domain of the magnetic plate by applying at least one of heat, a magnetic field and an external force to the magnetic plate.

The magnetic plate moving part may include: a vertical moving part configured to fix the magnetic plate seating part and to move the magnetic plate seating part in a vertical direction; a first horizontal moving part connected to the vertical moving part and configured to move the vertical moving part in a first horizontal direction; and a second horizontal moving part connected to the first horizontal moving part and configured to move the first horizontal moving part in a second horizontal direction intersected with the first horizontal direction.

The vertical moving part may include: a plate bracket coupled to the magnetic plate seating part; a vertical screw threadedly coupled to the plate bracket and configured to, when rotated, move the plate bracket in the vertical direction; a vertical movement guide disposed in the vertical direction through the plate bracket so as to be spaced apart from the vertical screw and configured to guide movement of the plate bracket during rotation of the vertical screw; and a vertical motor configured to rotate the vertical screw.

The first horizontal moving part may include: a first holder coupled to the plate bracket; a first horizontal screw threadedly coupled to the first holder and configured to, when rotated, move the first holder in the first horizontal direction; a first horizontal movement guide disposed in the first horizontal direction through the first holder so as to be spaced apart from the first horizontal screw and configured to guide movement of the first holder during rotation of the first horizontal screw; and a first horizontal motor configured to rotate the first horizontal screw.

The second horizontal moving part may include: a connector connected to the first horizontal movement guide; a second holder coupled to the connector; a second horizontal screw threadedly coupled to the second holder and configured to, when rotated, move the second holder in the second horizontal direction; a second horizontal movement guide disposed in the second horizontal direction through the second holder so as to be spaced apart from the second horizontal screw and configured to guide movement of the second holder during rotation of the second horizontal screw; and a second horizontal motor configured to rotate the second horizontal screw.

The magnetic domain deforming module may include: a magnetic domain deforming part configured to apply at least one of heat, a magnetic field and an external force to the magnetic plate when the magnetic plate is seated on the magnetic plate seating part; at least one horizontal support part coupled to the magnetic domain deforming part and configured to extend across the magnetic plate seating part; and a vertical support part extending from an end of the horizontal support part toward a base surface.

The magnetic domain deforming part may be provided as one of a permanent magnet, an electromagnet, a laser temperature converter and an electromagnetic wave irradiator.

The magnetic domain deforming part may include: a pinion gear coupled to the horizontal support part; a rack gear meshed with the pinion gear so as to move up and down; and a rigid body coupled to the rack gear to press the magnetic plate when the rack gear moves down.

The magnetic domain deforming part may be disposed to face at least one of an upper surface and a lower surface of the magnetic plate seated on the magnetic plate seating part.

In accordance with a second aspect of the present disclosure, there is provided a magnetic domain drawing apparatus, including: a magnetic plate fixing module including a magnetic plate seating part configured to hold a magnetic plate seated thereon; and a magnetic domain deforming module disposed at at least one of an upper side and a lower side of the magnetic plate seating part and configured to deform a magnetic domain of the magnetic plate when the magnetic plate is seated on the magnetic plate seating part, wherein the magnetic domain deforming module includes: a magnetic domain deforming part configured to apply at least one of heat, a magnetic field and an external force to the magnetic plate when the magnetic plate is seated on the magnetic plate seating part; and a magnetic domain deforming part moving part configured to move the magnetic domain deforming part.

In accordance with a third aspect of the present disclosure, there is provided a magnetic domain drawing apparatus, including: a magnetic plate moving module including a magnetic plate seating part configured to hold a magnetic plate seated thereon and a magnetic plate moving part configured to move the magnetic plate seating part; and a magnetic domain deforming module including a magnetic domain deforming part configured to apply at least one of heat, a magnetic field and an external force to the magnetic plate when the magnetic plate is seated on the magnetic plate seating part and a magnetic domain deforming part moving part configured to move the magnetic domain deforming part.

The first horizontal direction may be perpendicular to the second horizontal direction.

The vertical direction may be perpendicular to the first horizontal direction and the second horizontal direction The at least one of magnetic domain deforming modules may include a magnetic domain deforming module disposed on one of an upper side and a lower side of the magnetic plate seating part.

The at least one of magnetic domain deforming modules may include two magnetic domain deforming modules respectively disposed on an upper side and a lower side of the magnetic plate seating part.

With the magnetic domain drawing apparatus according to one embodiment of the present disclosure, it is possible to easily deform a magnetic domain of a magnetic plate.

DETAILED DESCRIPTION

Figure 1:
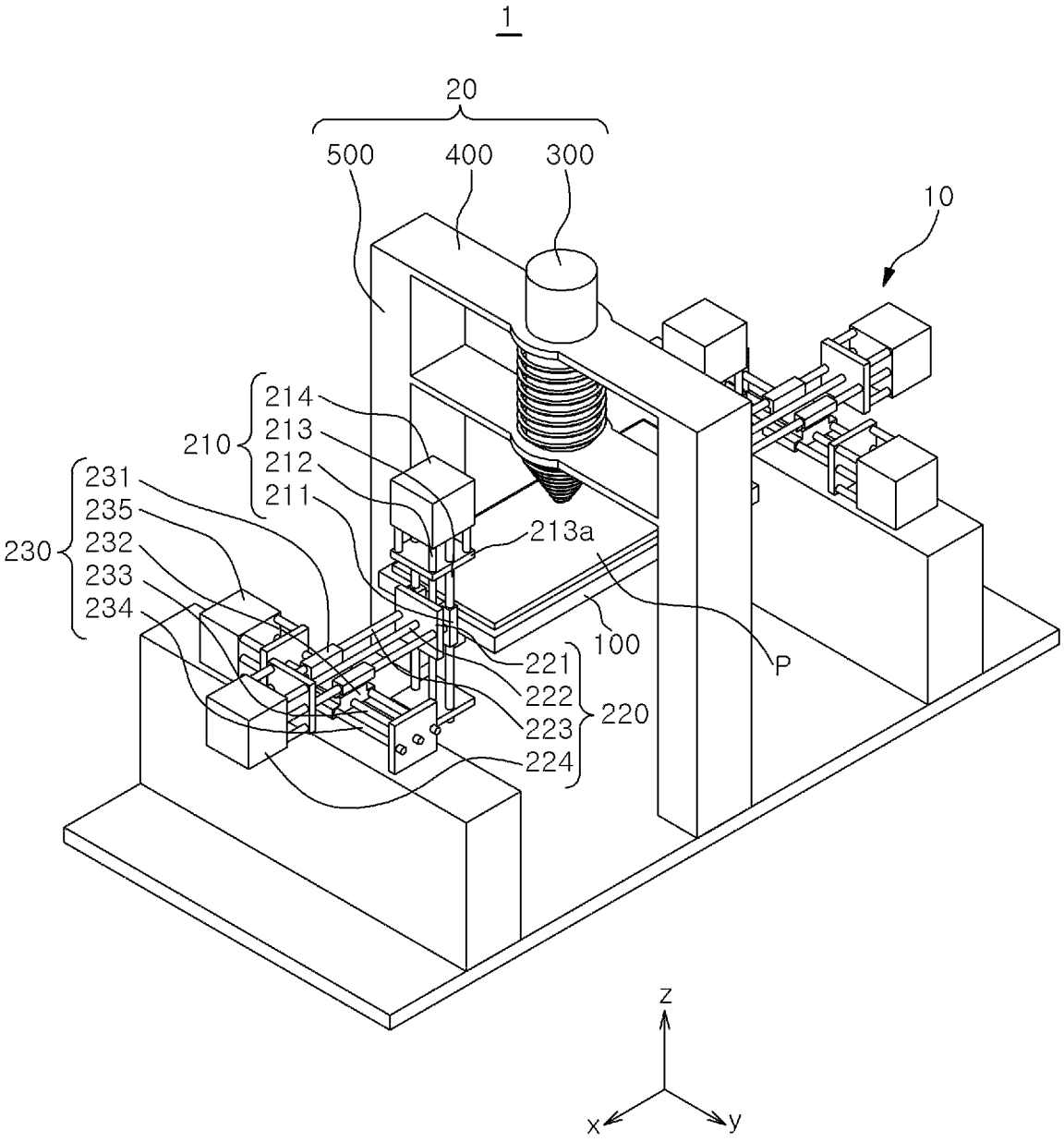
FIG. 1 is a perspective view of a magnetic domain drawing apparatus according to one embodiment of the present disclosure.
Figure 2:
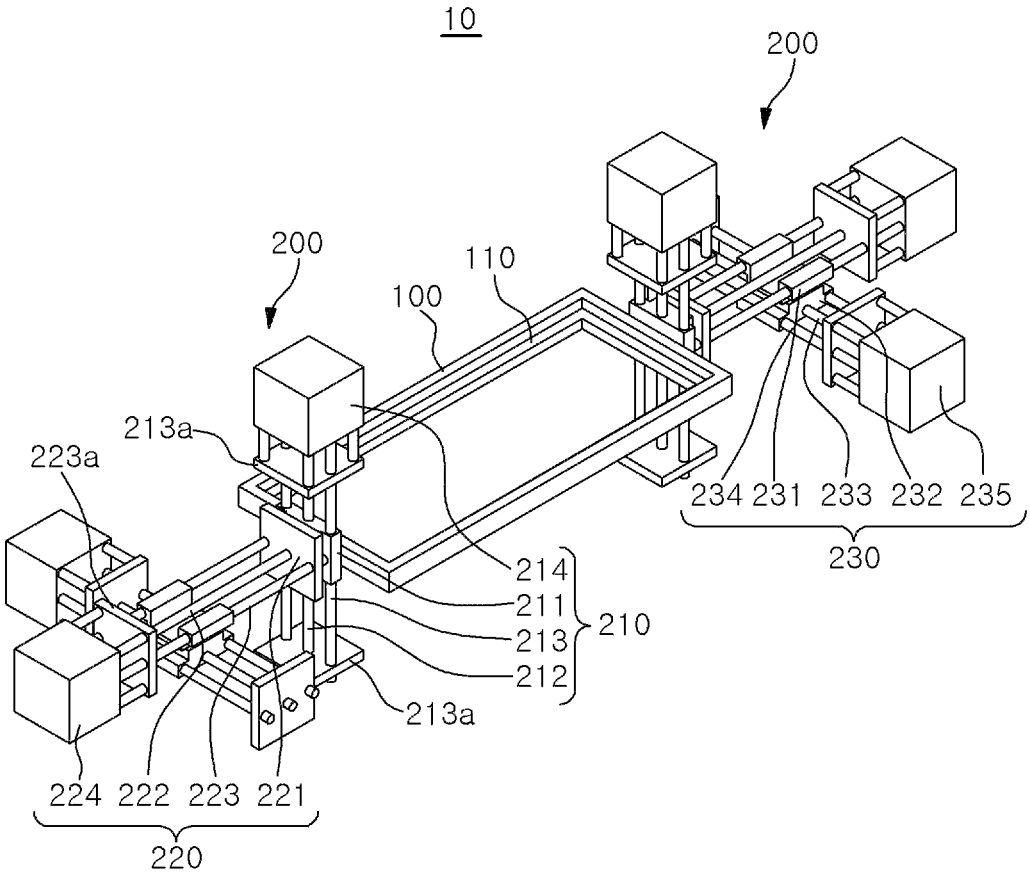
FIG. 2 is a perspective view of a magnetic plate moving module according to one embodiment of the present disclosure.
Figure 3:
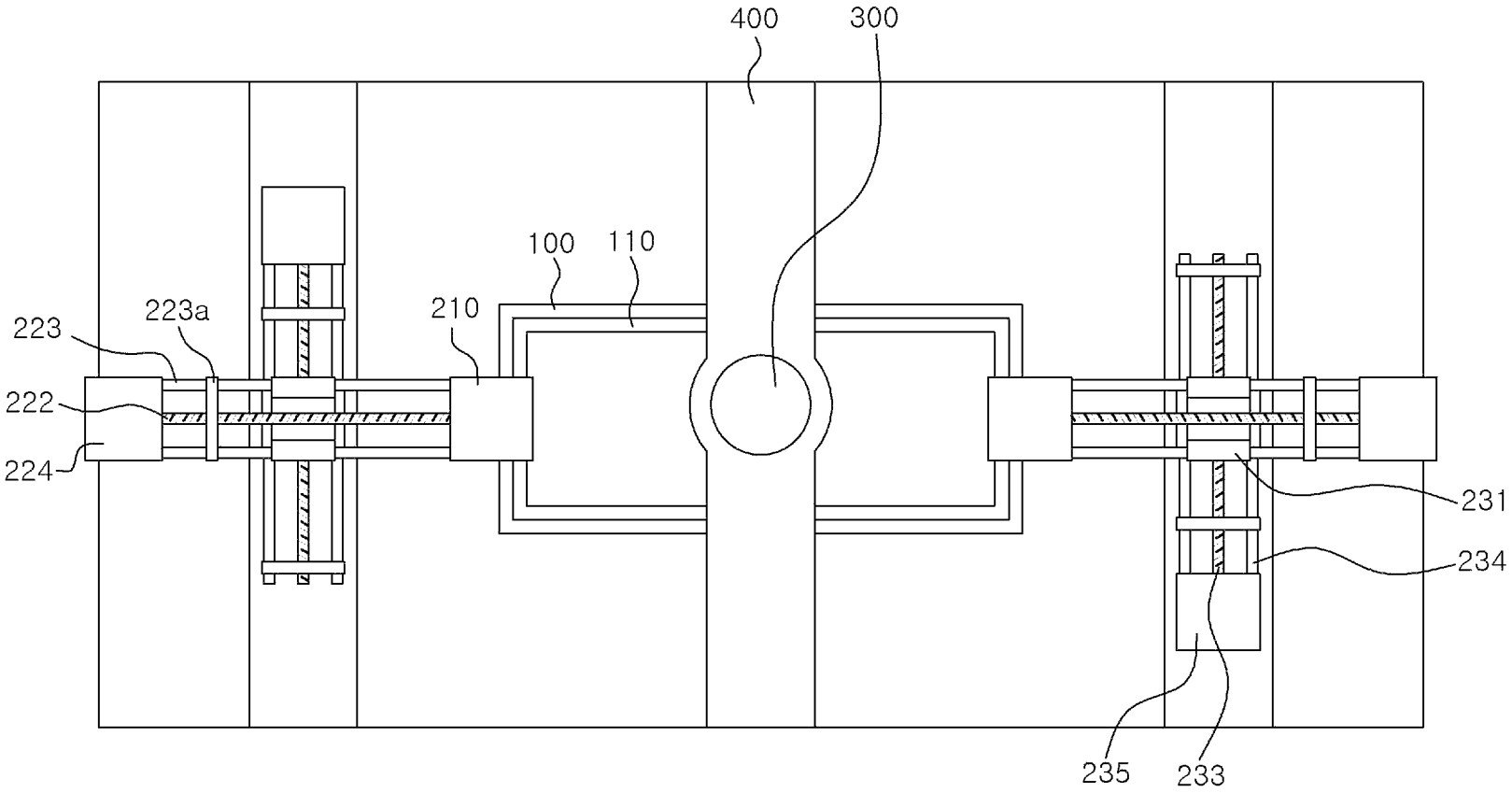
FIG. 3 is a plan view of the magnetic plate moving module according to one embodiment of the present disclosure.
Figure 4:
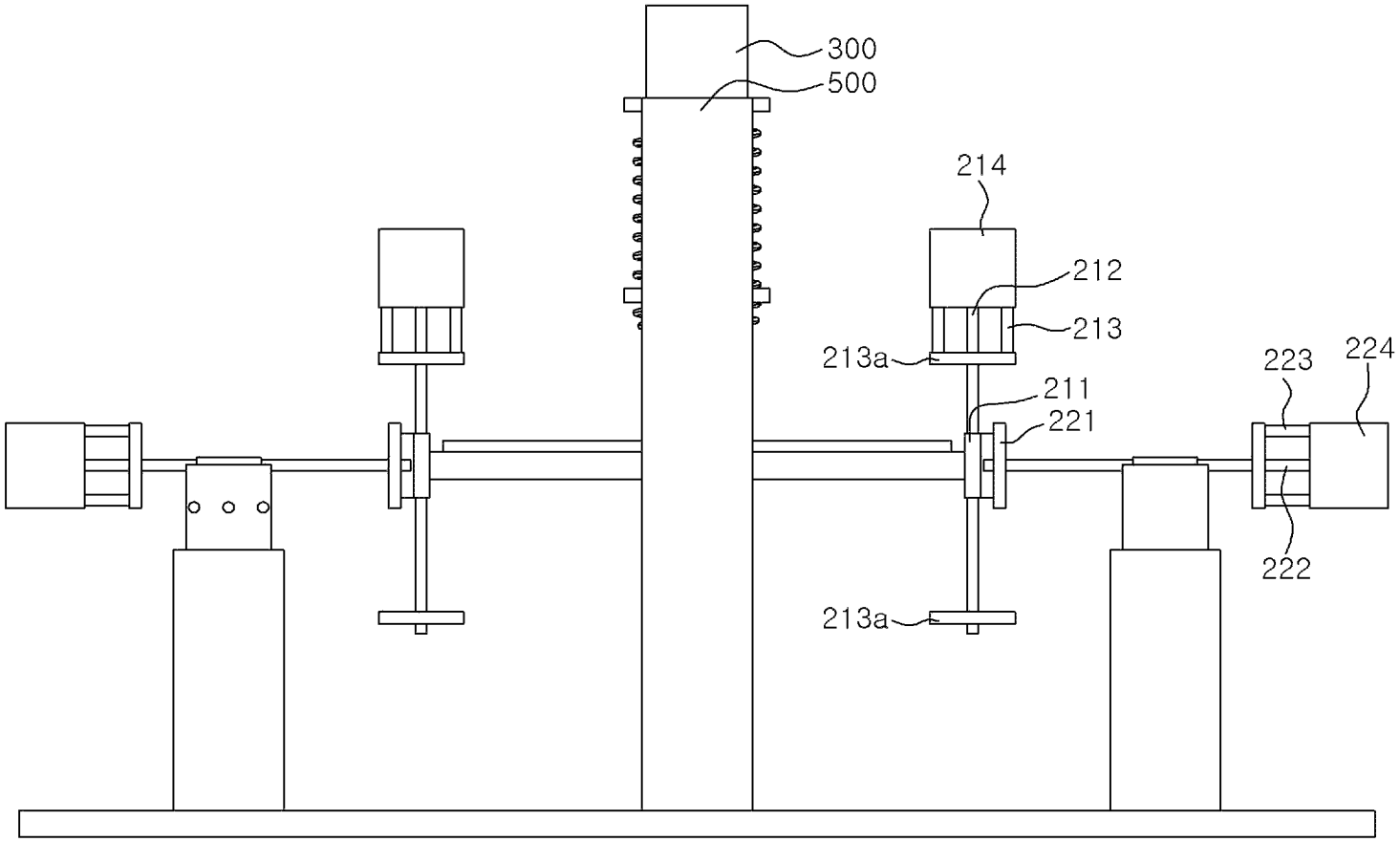
FIG. 4 is a side view of the magnetic plate moving module according to one embodiment of the present disclosure.

While the foregoing has described what are considered to be the best mode and/or other examples based on the principle that the inventor can properly define his own disclosure as the concept of the term, the terms and words used in the specification and claims described below shall not be interpreted in a conventional or dictionary sense, but shall be interpreted in terms of meaning and concepts conforming to the technical spirit of the present disclosure. Therefore, since the embodiments described in the specification and the configurations shown in the drawings are only the most preferred embodiments of the present disclosure, and do not represent all of the technical spirit of the present disclosure, it should be understood that there may be various equivalents and variations that could substitute them at the time of the present application.

Hereinafter, preferable embodiments of the present disclosure will be described in detail with reference to the accompanying drawings. It should be noted that the same component in the drawing is represented by the same symbol as possible. Further, a detailed description of the known function and configuration that may obscure the gist of this disclosure will be omitted. For the same reason, some components in the drawings are exaggerated, omitted or schematically illustrated, and the size of each component does not exactly reflect its actual size.

Referring to FIGS. 1 to 5, the magnetic domain drawing apparatus 1 according to one embodiment of the present disclosure is configured to deform a magnetic domain of a magnetic plate, and may include a magnetic plate moving module 10 including a magnetic plate seating part 100 and a magnetic plate moving part 200, and a magnetic domain deforming module 20 for deforming the magnetic domain of the magnetic plate.

A magnetic plate P may be seated on the magnetic plate seating part 100. For this purpose, the magnetic plate seating part 100 may be provided with a step-shaped protrusion 110. At least a portion of the upper and lower surfaces of the magnetic plate seating part 100 may be opened. Therefore, when the magnetic plate p is seated on the magnetic plate seating part 100, at least a portion of the upper and lower surfaces of the magnetic plate p may be exposed to the outside.

In this regard, the magnetic plate P may include, for example, a rubber magnet, a ferrite magnet, or the like. The magnetic plate P may contain a material whose magnetic domain can be changed when exposed to any one of heat, a pressure, an electromagnetic wave and a magnetic field supplied from the outside.

The magnetic plate moving part 200 may be connected to the magnetic plate seating part 100. The magnetic plate moving part 200 is provided to move the magnetic plate seating part 100. The magnetic plate moving part 200 may include vertical moving parts 210 configured to fix the magnetic plate seating part 100 and to move the magnetic plate seating part 100 in a vertical direction, first horizontal moving parts 220 connected to the vertical moving parts 210 to move the vertical moving parts 210 in a first horizontal direction, and second horizontal moving parts 230 connected to the first horizontal moving parts 220 to move the first horizontal moving parts 220 in a second horizontal direction intersected with the first horizontal direction. In this regard, the vertical direction, the first horizontal direction and the second horizontal direction may be provided at right angles to each other. For example, the vertical direction may refer to a z-axis direction in FIG. 1, the first horizontal direction may refer to a x-axis direction in FIG. 1, and the second horizontal direction may refer to a y-axis direction in FIG. 1.

The vertical moving parts 210 may be connected to the magnetic plate seating part 100 to move the magnetic plate seating part 100 in the vertical direction. In other words, the vertical moving parts 210 may move the magnetic plate seating part 100 in the z-axis direction.

Each of the vertical moving part 210 may include, for example, a plate bracket 211 coupled to the magnetic plate seating part 100, a vertical screw 212 threadedly coupled through the plate bracket 211, a vertical movement guide 213 disposed in the vertical direction to extend through the plate bracket 211 and spaced apart from the vertical screw 212, and a vertical motor 214 configured to rotate the vertical screw 212.

Figure 5:
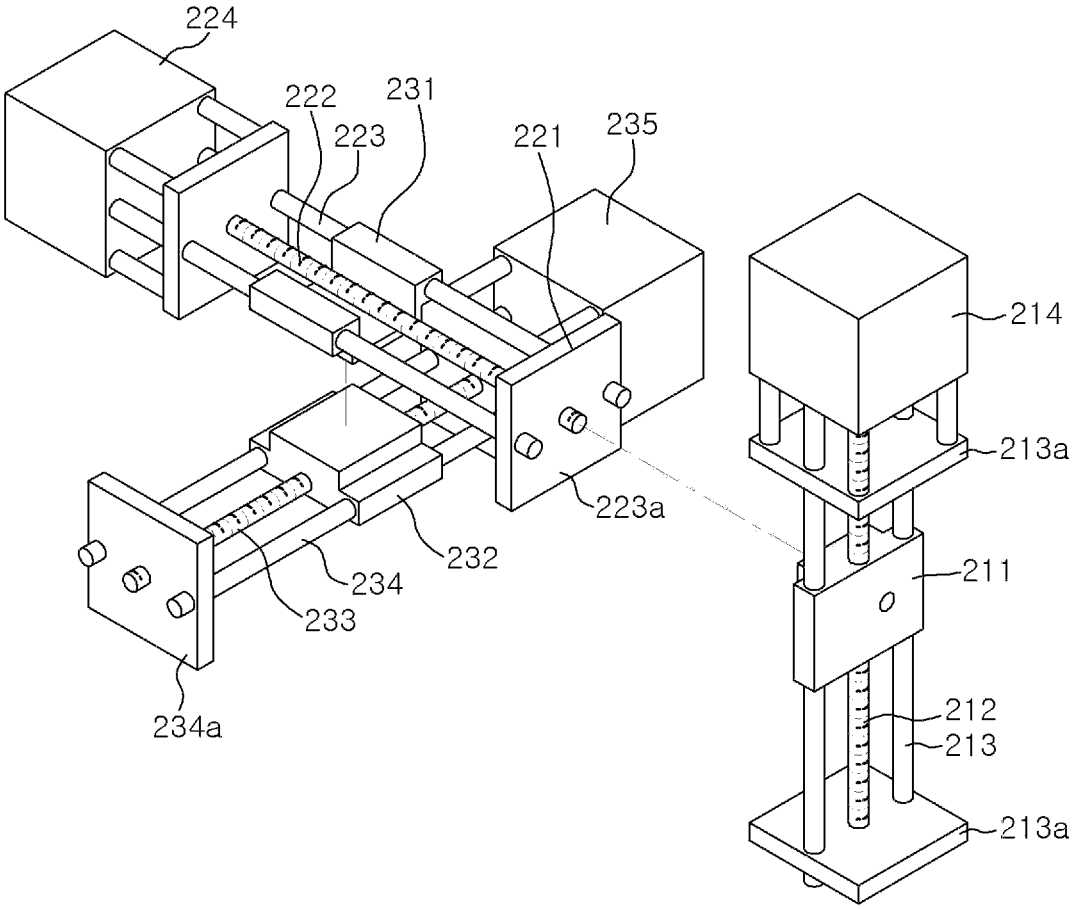
FIG. 5 is an exploded perspective view of a magnetic plate moving part according to one embodiment of the present disclosure.

The plate bracket 211 may be provided at a side of the magnetic plate seating part 100 and may be coupled to an outer surface of the magnetic plate seating part 100. The plate bracket 211 may move up and down in the vertical direction as the vertical motor 214 rotates. In other words, the vertical screw 212 may penetrate through the plate bracket 211 to be threadedly coupled to the plate bracket 211, and the vertical movement guide 213 may be coupled to a side portion of the plate bracket 211 in the vertical direction. In FIG. 5, two vertical movement guides 213 are coupled to both side portions of the plate bracket 211 in the vertical direction. At this time, an end of the vertical movement guide 213 in the vertical direction may be restrained by an additional fixing member 213*a* so as to prevent the plate bracket 211 from moving in a direction other than the vertical direction. Therefore, when the vertical motor 214 rotates to rotate the vertical screw 212, the plate bracket 211 may be moved upward or downward along the vertical movement guide 213 according to the rotation direction of the vertical screw 212. In this case, the vertical motor 214 may be provided as a stepping motor.

The first horizontal moving parts 220 may be connected to the vertical moving parts 210 to move the vertical moving parts 210 in the first horizontal direction. In other words, the first horizontal moving parts 220 may move the vertical moving parts 210 in the x-axis direction. As the vertical moving parts 210 move in the first horizontal direction, the magnetic plate seating part 100 connected to the vertical moving parts 210 may move in the first horizontal direction.

Each of the first horizontal moving parts 220 may include, for example, a first holder 221 coupled to the plate bracket 211, a first horizontal screw 222 configured to move the first holder 221 in the first horizontal direction, a first horizontal movement guide 223 extending through the first holder 221 in the first horizontal direction and spaced apart from the first horizontal screw 222, and a first horizontal motor 224 configured to rotate the first horizontal screw 222.

The first holder 221 may be coupled to the plate bracket 211 mechanically or in a welding or bonding manner. The first holder 221 may move in the first horizontal direction as the first horizontal motor 224 rotates. In other words, the first horizontal screw 222 may be threadedly coupled through the first holder 221, and the first horizontal movement guide 223 may be coupled to a side portion of the first holder 221 in the first horizontal direction. In FIG. 5, two first horizontal movement guides 223 are coupled to both side portions of the first holder 221 in the first horizontal direction. At this time, an end of the first horizontal movement guide 223 in the first horizontal direction may be restrained by an additional fixing member 223*a* so as to prevent the first holder 221 from moving in a direction other than the first horizontal direction. Therefore, when the first horizontal motor 224 rotates to rotate the first horizontal screw 222, the first holder 221 may move forward or backward along the first horizontal movement guide 223 in the first horizontal direction according to the rotation direction of the first horizontal screw 222. In this regard, the first horizontal motor 224 may be provided as a stepping motor.

The second horizontal moving parts 230 may be connected to the first horizontal moving parts 220 to move the first horizontal moving parts 220 in the second horizontal direction. In other words, the second horizontal moving parts 230 may move the first horizontal moving parts 220 in the y-axis direction.

Each of the second horizontal moving parts 230 may include, for example, a connector 231 connected to the first horizontal moving part 220, a second holder 232 coupled to the connector 231, a second horizontal screw 233 configured to move the second holder 232 in the second horizontal direction, a second horizontal movement guide 234 disposed in the second horizontal direction to extend through the second holder 232 and spaced apart from the second horizontal screw 233, and a second horizontal motor 235 configured to rotate the second horizontal screw 233.

The connector 231 may be connected to the first horizontal moving part 220. For example, the connector 231 may be connected to the first horizontal movement guide 223 of the first horizontal moving part 220. The second holder 232 may be connected to the connector 231. The second holder 232 may be mechanically fastened to the connector 231, or may be coupled to the connector 231 in a bonding or welding manner.

The second holder 232 may move in the second horizontal direction as the second horizontal screw 233 rotates. In other words, the second horizontal screw 233 may be threadedly coupled through the second holder 232, and the second horizontal movement guide 234 may be coupled to a side portion of the second holder 232 in the second horizontal direction. In FIG. 5, two second horizontal movement guides 234 are coupled to both side portions of the second holder 232 in the second horizontal direction. At this time, an end of the second horizontal movement guide 234 in the second horizontal direction may be restrained by an additional fixing member 234*a* so as to prevent the second holder 232 from moving in a direction other than the second horizontal direction. Therefore, when the second horizontal motor 235 rotates to rotate the second horizontal screw 223, the second holder 232 may move forward or backward along the second horizontal movement guide 234 in the second horizontal direction according to the rotation direction of the second horizontal screw 223. In this regard, the second horizontal motor 235 may be provided as a stepping motor.

As described above, the magnetic domain drawing apparatus 1 according to one embodiment of the present disclosure includes the vertical moving part 210, the first horizontal moving part 220 and the second horizontal moving part 230. This makes it possible to three-dimensionally move the magnetic plate seating part 100.

The magnetic domain deforming module 20 is provided to deform the magnetic domain of the magnetic plate P seated on the magnetic plate seating part 100. The magnetic domain deforming module 20 may include a magnetic domain deforming part 300 configured to apply at least one of heat, a magnetic field and an external force to the magnetic plate P when the magnetic plate P is seated on the magnetic plate seating part 100, at least one horizontal support part 400 coupled to the magnetic domain deforming part 300 and configured to extend across the magnetic plate seating part 100, and a vertical support part 500 extending from the end of the horizontal support part 400 toward a base surface.

Figure 6:
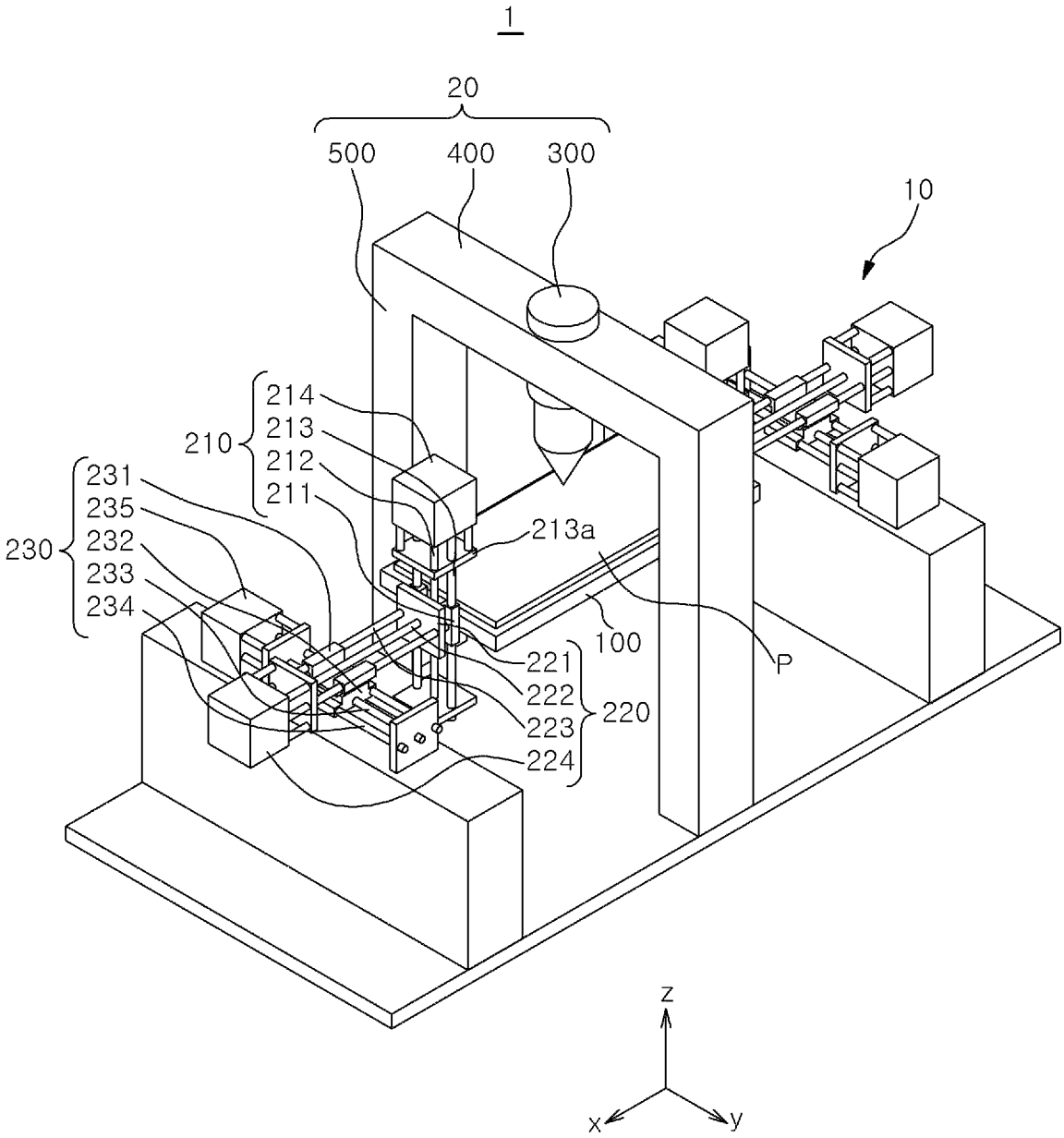
FIG. 6 is a perspective view of a magnetic domain drawing apparatus according to another embodiment of the present disclosure.

The magnetic domain deforming part 300 may deform the magnetic domain of the magnetic plate P by applying a magnetic field to the magnetic plate P, and may be provided as, for example, an electromagnet including a solenoid coil (see, FIG. 1) or a strong permanent magnet (see, FIG. 6). The user may deform the magnetic domain of the magnetic plate P into a desired shape by adjusting the position of the magnetic plate P disposed under the electromagnet or the permanent magnet.

Figure 7:
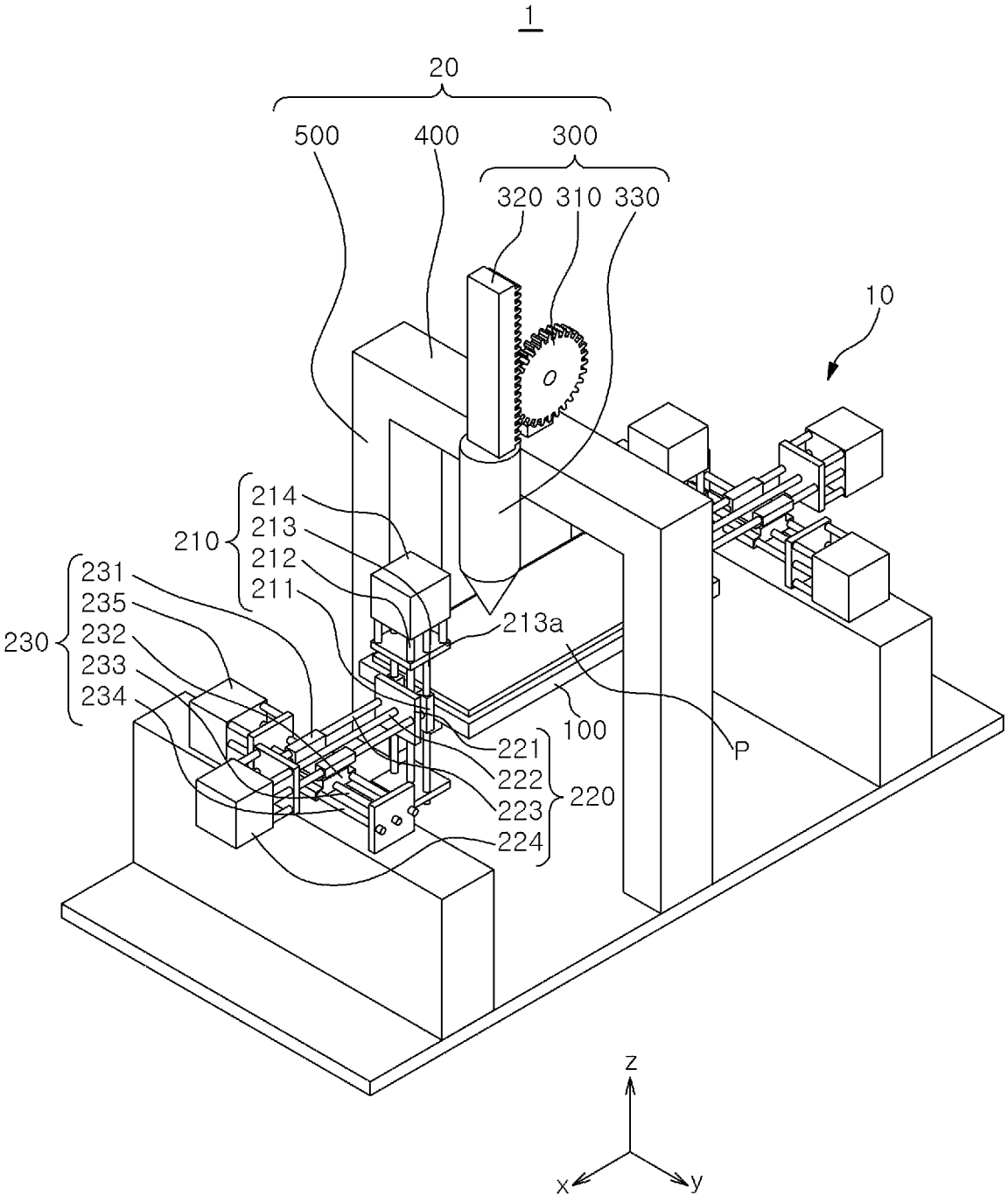
FIG. 7 is a perspective view of a magnetic domain drawing apparatus according to a further embodiment of the present disclosure.

In addition, the magnetic domain deforming part 300 may deform the magnetic domain of the magnetic plate P by applying an external force to the magnetic plate P. For example, referring to FIG. 7, the magnetic domain deforming part 300 may include a pinion gear 310 coupled to the horizontal support part 400, a rack gear 320 meshed with the pinion gear 310 so as to move up and down, and a rigid body 330 coupled to the rack gear 320 to press the magnetic plate P when the rack gear 320 moves down. The magnetic domain deforming part 300 may deform the magnetic domain of the magnetic plate P by pressing the surface of the magnetic plate P. The user may deform the magnetic domain of the magnetic plate P into a desired shape by adjusting the position of the magnetic plate P disposed below the rigid body 330.

In addition, the magnetic domain deforming part 300 may be provided as a Laser temperature converter configured to deform the magnetic domain of the magnetic plate P by irradiating a laser beam to the magnetic plate P and changing the temperature of the magnetic plate P or an electromagnetic wave irradiator configured to deform the magnetic domain of the magnetic plate P by irradiating an electromagnetic wave to the magnetic plate P.

Figure 8:
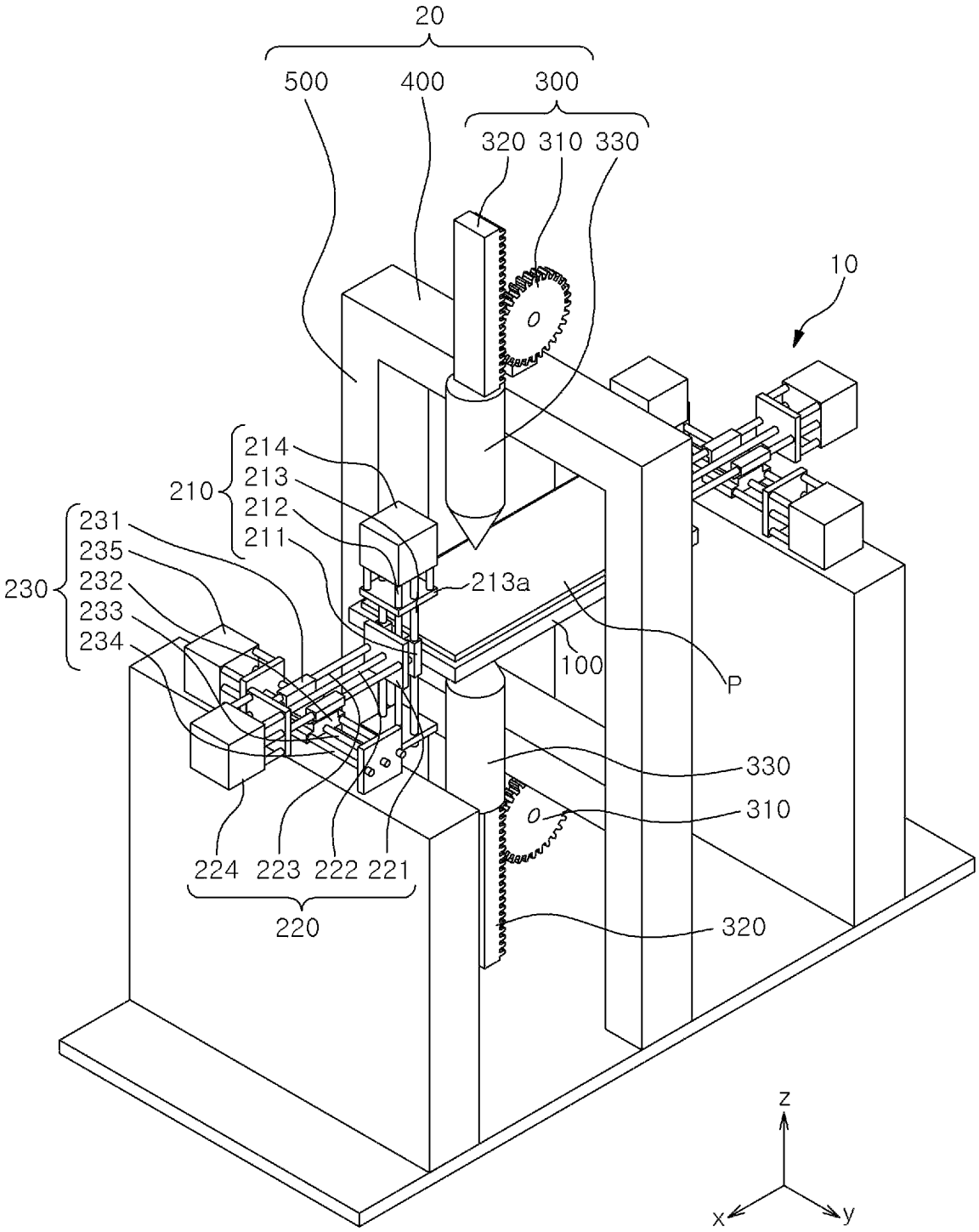
FIG. 8 is a perspective view of a magnetic domain drawing apparatus according to a still further embodiment of the present disclosure.

Meanwhile, referring to FIG. 8, the magnetic domain deforming part 300 may be disposed above and below the magnetic plate seating part 100. In other words, the magnetic domain deforming part 300 may be disposed on at least one of the upper side and the lower side of the magnetic plate seating part 100 so as to face the upper or lower surface of the seated magnetic plate P.

Since the magnetic plate seating part 100 are open in the vertical direction, it is also possible to arrange the magnetic domain deforming part 300 on both the upper side and the lower side of the magnetic plate seating part 100 to change the magnetic domain of the magnetic plate P. In FIG. 8, there is shown only the configuration in which the magnetic domain deforming part 300 including the rigid body 330 is disposed on both the upper side and the lower side of the magnetic plate seating part 100. The magnetic domain deforming part 300 is replaced by a permanent magnet, an electromagnet, a laser temperature converter, or an electromagnetic wave irradiator.

Figure 9:
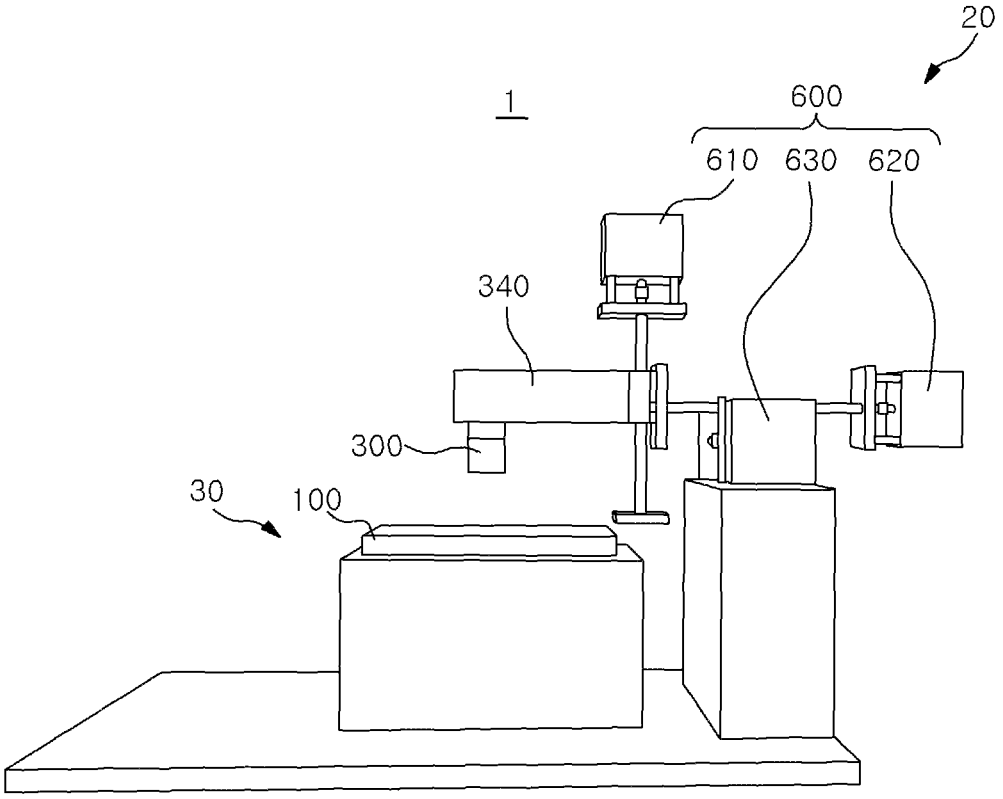
FIG. 9 is a perspective view of a magnetic domain drawing apparatus according to a yet still further embodiment of the present disclosure.

Meanwhile, referring to FIG. 9, the magnetic domain drawing apparatus 1 according to another embodiment of the present disclosure may include a magnetic plate fixing module 30 including the magnetic plate seating part 100 configured to hold the magnetic plate P seated thereon, and a magnetic domain deforming module 20 disposed on at least one of an upper side and a lower side of the magnetic plate seating part 100 and configured to deform a magnetic domain of the magnetic plate P when the magnetic plate P is seated on the magnetic plate seating part 100. The magnetic domain deforming module 20 includes a magnetic domain deforming part 600 configured to apply at least one of heat, a magnetic field and an external force to the magnetic plate when the magnetic plate P is seated on the magnetic plate seating part 100, and a magnetic domain deforming part moving part 600 configured to move the magnetic domain deforming part 300. The magnetic domain deforming part 300 may be connected to the magnetic domain deforming part moving part 600 through a separate bracket 340. The magnetic domain deforming part moving part 600 may include a vertical moving part 610 configured to move the magnetic domain deforming part 300 in the vertical direction, a first horizontal moving part 620 connected to the vertical moving part 610 to move the vertical moving part 610 in a first horizontal direction, and a second horizontal moving part 630 connected to the first horizontal moving part 620 to move the first horizontal moving part 620 in a second horizontal direction intersected with the first horizontal direction. In this regard, the vertical moving part 610, the first horizontal moving part 620 and the second horizontal moving part 630 of the magnetic domain drawing apparatus 1 according to another embodiment of the present disclosure shown in FIG. 9 have the same configurations as the vertical moving part 210, the first horizontal moving part 220 and the second horizontal moving part 230 of the magnetic plate moving part 200 described above with reference to FIGS. 1 to 8. Therefore, detailed description thereof is omitted and replaced with the foregoing description.

Figure 10:
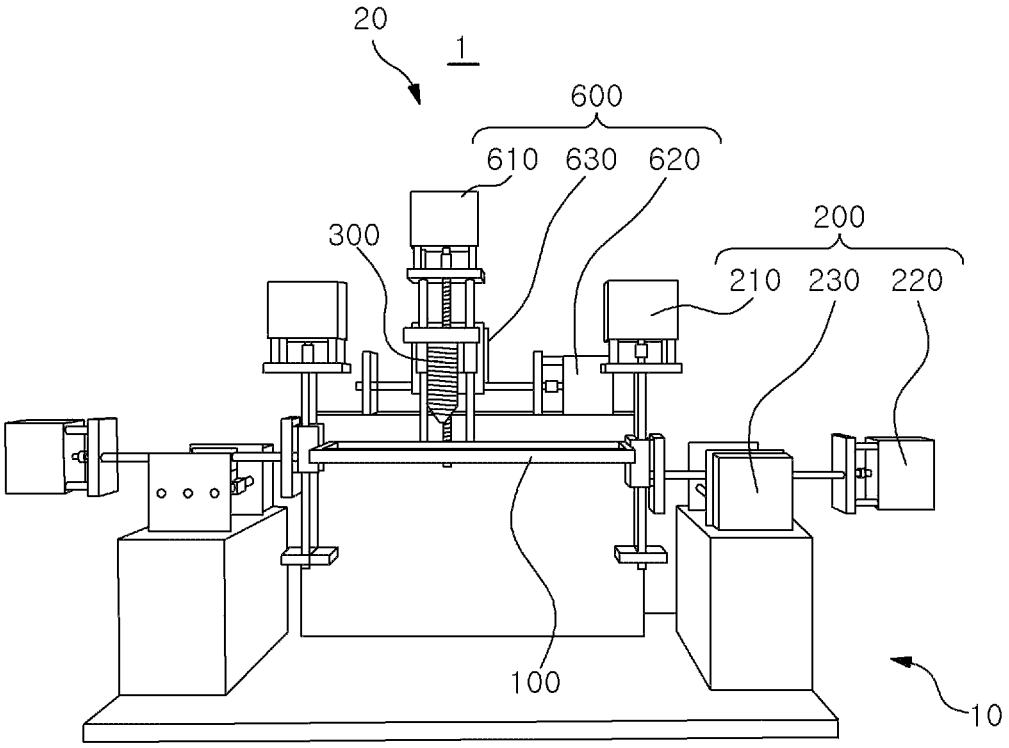
FIG. 10 is a perspective view of a magnetic domain drawing apparatus according to an even yet still further embodiment of the present disclosure.
Figure 11:
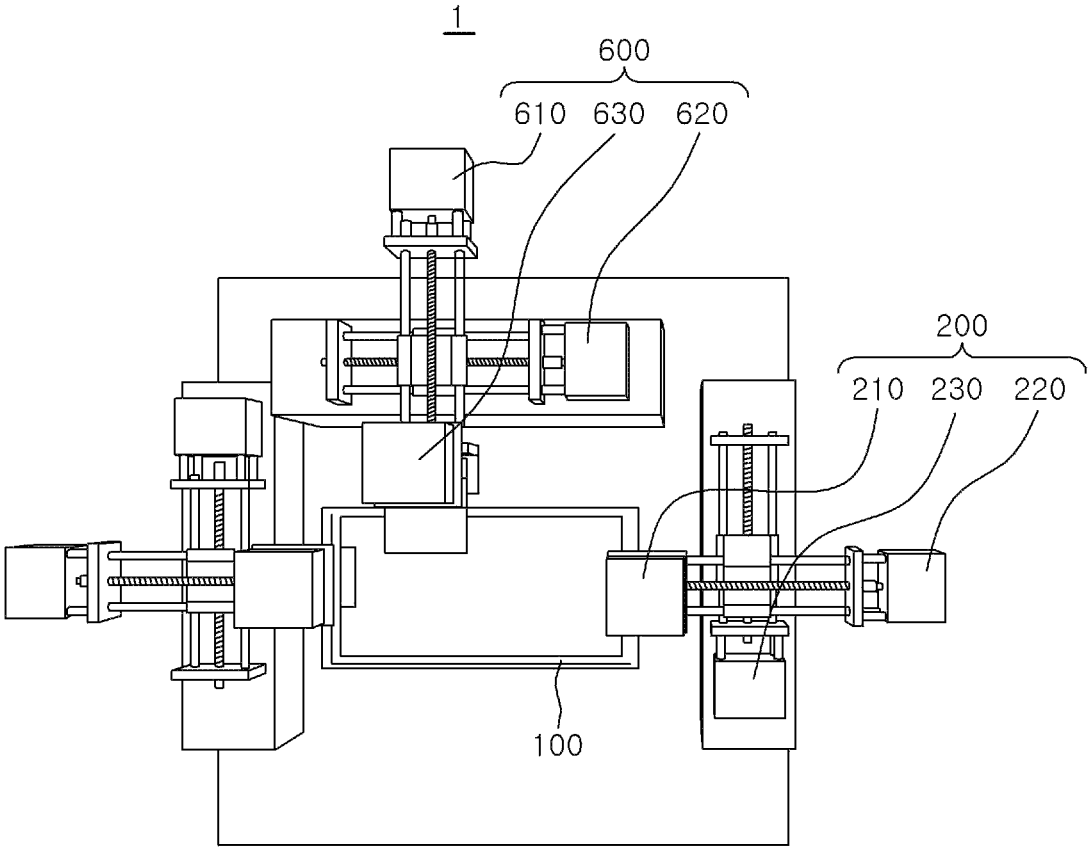
FIG. 11 is a perspective view of the magnetic domain drawing apparatus shown in FIG. 10, which is seen from another angle.

Meanwhile, referring to FIGS. 10 and 11, the magnetic domain drawing apparatus 1 according to a further embodiment of the present disclosure may include a magnetic plate moving module 10 including a magnetic plate seating part 100 configured to hold a magnetic plate P seated thereon and a magnetic plate moving part 200 configured to move the magnetic plate seating part 100, and a magnetic domain deforming module 20 including a magnetic domain deforming part 300 configured to apply at least one of heat, a magnetic field and an external force to the magnetic plate P when the magnetic plate P is seated on the magnetic plate seating part 100 and a magnetic domain deforming part moving part 600 configured to move the magnetic domain deforming part 300. In this regard, the magnetic plate moving module 10 of the magnetic domain drawing apparatus 1 shown in FIGS. 10 and 11 may have the same configuration as the magnetic plate moving module 10 of the magnetic domain drawing apparatus 1 shown in FIGS. 1 to 8. In addition, the magnetic domain deforming module 20 of the magnetic domain drawing apparatus 1 shown in FIGS. 10 and 11 may have the same configuration as the magnetic domain deforming module 20 of the magnetic domain drawing apparatus 1 shown in FIG. 9. Therefore, detailed description thereof is omitted and replaced with the foregoing description.

Meanwhile, a manual operation or an electrically-driven program may be used as a method of driving the magnetic domain drawing apparatus 1 according to each of the embodiments of the present disclosure. The program used when using an electrically-driven program may include various programs commonly used in the art, such as, for example, MATLAB, LabVIEW, Aduino, and the like.

As described above, the magnetic domain drawing apparatus according to each of the embodiments of the present disclosure includes the magnetic plate moving module 10 and the magnetic domain deforming module 20. This makes it possible to easily deform the magnetic domain of the magnetic plate P and to perform a magnetic printing operation in a desired pattern.

While the configuration and features of the present disclosure has been shown and described with respect to the embodiments in accordance with the present disclosure, the present disclosure is not limited thereto. It will be apparent to those skilled in the art to make various changes or modifications within the spirit and scope of the present disclosure, and thus, such changes or modifications are found to belong to the appended claims.

What is claimed is:

1. A magnetic domain drawing apparatus, comprising:

a magnetic plate moving module including a magnetic plate seating part configured to hold a magnetic plate seated thereon and a magnetic plate moving part configured to move the magnetic plate seating part; and at least one of magnetic domain deforming modules disposed to be spaced apart from the magnetic plate seating part at a predetermined distance and configured to deform a magnetic domain of the magnetic plate when the magnetic plate is seated on the magnetic plate seating part, wherein the at least one of magnetic domain deforming modules is configured to deform the magnetic domain of the magnetic plate by applying at least one of heat, a magnetic field and an external force to the magnetic plate, wherein the magnetic plate moving part comprises:

a vertical moving part configured to fix the magnetic plate seating part and to move the magnetic plate seating part in a vertical direction, and wherein the vertical moving part comprises:

a plate bracket coupled to the magnetic plate seating part;

a vertical screw threadedly coupled to the plate bracket and configured to, when rotated, move the plate bracket in the vertical direction;

a vertical movement guide disposed in the vertical direction through the plate bracket so as to be spaced apart from the vertical screw and configured to guide movement of the plate bracket during rotation of the vertical screw; and a vertical motor configured to rotate the vertical screw.

2. The apparatus of claim 1, wherein the magnetic plate moving part further includes:

a first horizontal moving part connected to the vertical moving part and configured to move the vertical moving part in a first horizontal direction; and a second horizontal moving part connected to the first horizontal moving part and configured to move the first horizontal moving part in a second horizontal direction intersected with the first horizontal direction.

3. The apparatus of claim 2, wherein the first horizontal moving part comprises:

a first holder coupled to the plate bracket;

a first horizontal screw threadedly coupled to the first holder and configured to, when rotated, move the first holder in the first horizontal direction;

a first horizontal movement guide disposed in the first horizontal direction through the first holder so as to be spaced apart from the first horizontal screw and configured to guide movement of the first holder during rotation of the first horizontal screw; and a first horizontal motor configured to rotate the first horizontal screw.

4. The apparatus of claim 3, wherein the second horizontal moving part comprises:

a connector connected to the first horizontal movement guide;

a second holder coupled to the connector;

a second horizontal screw threadedly coupled to the second holder and configured to, when rotated, move the second holder in the second horizontal direction;

a second horizontal movement guide disposed in the second horizontal direction through the second holder so as to be spaced apart from the second horizontal screw and configured to guide movement of the second holder during rotation of the second horizontal screw; and a second horizontal motor configured to rotate the second horizontal screw.

5. The apparatus of claim 1, wherein the magnetic domain deforming module comprises:

a magnetic domain deforming part configured to apply at least one of heat, a magnetic field and an external force to the magnetic plate when the magnetic plate is seated on the magnetic plate seating part;

at least one horizontal support part coupled to the magnetic domain deforming part and configured to extend across the magnetic plate seating part; and a vertical support part extending from an end of the horizontal support part toward a base surface.

6. The apparatus of claim 5, wherein the magnetic domain deforming part is provided as one of a permanent magnet, an electromagnet, a laser temperature converter and an electromagnetic wave irradiator.

7. The apparatus of claim 5, wherein the magnetic domain deforming part comprises:

a pinion gear coupled to the horizontal support part;

a rack gear meshed with the pinion gear so as to move up and down; and a rigid body coupled to the rack gear to press the magnetic plate when the rack gear moves down.

8. The apparatus of claim 5, wherein the magnetic domain deforming part is disposed to face at least one of an upper surface and a lower surface of the magnetic plate seated on the magnetic plate seating part.

9. The apparatus of claim 2, wherein the first horizontal direction is perpendicular to the second horizontal direction.

10. The apparatus of claim 9, wherein the vertical direction is perpendicular to the first horizontal direction and the second horizontal direction.

11. The apparatus of claim 1, wherein the at least one of magnetic domain deforming modules includes a magnetic domain deforming module disposed on one of an upper side and a lower side of the magnetic plate seating part.

12. The apparatus of claim 1, wherein the at least one of magnetic domain deforming modules includes two magnetic domain deforming modules respectively disposed on an upper side and a lower side of the magnetic plate seating part.

13. A magnetic domain drawing apparatus, comprising:

a magnetic plate fixing module including a magnetic plate seating part configured to hold a magnetic plate seated thereon; and a magnetic domain deforming module disposed at at least one of an upper side and a lower side of the magnetic plate seating part and configured to deform a magnetic domain of the magnetic plate when the magnetic plate is seated on the magnetic plate seating part, wherein the magnetic domain deforming module includes:

a magnetic domain deforming part configured to apply at least one of heat, a magnetic field and an external force to the magnetic plate when the magnetic plate is seated on the magnetic plate seating part; and a magnetic domain deforming part moving part configured to move the magnetic domain deforming part, wherein the magnetic domain deforming part moving part comprises:

a vertical moving part configured to fix the magnetic domain deforming part and to move the magnetic domain deforming part in a vertical direction, and wherein the vertical moving part comprises:

a bracket coupled to the magnetic domain deforming part;

a vertical screw threadedly coupled to the bracket and configured to, when rotated, move the bracket in the vertical direction;

a vertical movement guide disposed in the vertical direction through the bracket so as to be spaced apart from the vertical screw and configured to guide movement of the bracket during rotation of the vertical screw; and a vertical motor configured to rotate the vertical screw.

14. A magnetic domain drawing apparatus, comprising:

a magnetic plate moving module including a magnetic plate seating part configured to hold a magnetic plate seated thereon and a magnetic plate moving part configured to move the magnetic plate seating part; and a magnetic domain deforming module including a magnetic domain deforming part configured to apply at least one of heat, a magnetic field and an external force to the magnetic plate when the magnetic plate is seated on the magnetic plate seating part and a magnetic domain deforming part moving part configured to move the magnetic domain deforming part, wherein the magnetic plate moving part comprises:

a vertical moving part configured to fix the magnetic plate seating part and to move the magnetic plate seating part in a vertical direction, and wherein the vertical moving part comprises:

a plate bracket coupled to the magnetic plate seating part;

a vertical screw threadedly coupled to the plate bracket and configured to, when rotated, move the plate bracket in the vertical direction;

a vertical movement guide disposed in the vertical direction through the plate bracket so as to be spaced apart from the vertical screw and configured to guide movement of the plate bracket during rotation of the vertical screw; and a vertical motor configured to rotate the vertical screw.

* * * * *